US011452368B1

(12) United States Patent
Li

(10) Patent No.: US 11,452,368 B1
(45) Date of Patent: Sep. 27, 2022

(54) RETRACTABLE AND FOLDABLE TABLE LEG STRUCTURE

(71) Applicant: SHENZHEN SUPER TOP INNOVATION TECHNOLOGY LIMITED, Shenzhen (CN)

(72) Inventor: Haifeng Li, Shenzhen (CN)

(73) Assignee: SHENZHEN SUPER TOP INNOVATION TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 17/357,954

(22) Filed: Jun. 24, 2021

(30) Foreign Application Priority Data

May 14, 2021 (CN) ..... 202121045083.8

(51) Int. Cl.
*A47B 3/08* (2006.01)
*A47B 9/00* (2006.01)

(52) U.S. Cl.
CPC . *A47B 3/08* (2013.01); *A47B 9/00* (2013.01)

(58) Field of Classification Search
CPC ..... A47B 3/08; A47B 3/0818; A47B 9/00; A47B 9/18; A47B 2003/0827
See application file for complete search history.

(56) References Cited

U.S. PATENT DOCUMENTS 4,927,128 A * 5/1990 O'Brian ..... A61G 13/105 269/901
2014/0090582 A1* 4/2014 Grace ..... A47B 9/20 108/106
2018/0085912 A1* 3/2018 Cindric ..... E06C 1/39
2019/0001481 A1* 1/2019 Faibish ..... B25H 1/04
2020/0154877 A1* 5/2020 Hurley ..... A47B 3/08
2020/0359780 A1* 11/2020 Nye ..... A47B 3/087

* cited by examiner

*Primary Examiner* — Daniel J Rohrhoff

(57) ABSTRACT

The present disclosure provides a retractable and foldable table leg structure, including a frame and a supporting leg. The frame defines a receiving cavity. The supporting leg includes a first supporting rod, a second supporting rod, a third supporting rod and a fourth supporting rod. The third supporting rod is slidably connected with the first supporting rod. The fourth supporting rod is slidably connected with the second supporting rod. The first supporting rod and the second supporting rod are rotatably connected with the frame, respectively. The supporting leg is configured to rotate to be received within the receiving cavity, and is adjustable in height by sliding the third supporting rod and the fourth supporting rod.

18 Claims, 10 Drawing Sheets

RETRACTABLE AND FOLDABLE TABLE LEG STRUCTURE

CROSS-REFERENCE TO RELATED APPLICATIONS

This application claims priority to Chinese Patent Application No. 202121045083.8, filed May 14, 2021, which is hereby incorporated by reference herein as if set forth in its entirety.

TECHNICAL FIELD

The present disclosure relates to a field of furniture, in particular to a retractable and foldable table leg structure.

BACKGROUND

A foldable computer table in the existing technology has its legs foldable. The folded computer table occupies little space and thus is convenient for transportation and storage. However, the foldable computer table in the existing technology has a fixed height as the legs thereof are not adjustable in length, which fails to meet the user's demand of adjusting the height of the table.

SUMMARY

The present disclosure provides a retractable and foldable table leg structure for solving the aforementioned problem.

The present disclosure is realized by the following technical solutions.

A retractable and foldable table leg structure is provided according to the present disclosure, including a frame and a supporting leg, where the frame defines a receiving cavity, the supporting leg includes a first supporting rod, a second supporting rod, a third supporting rod and a fourth supporting rod, the third supporting rod is slidably connected with the first supporting rod, the fourth supporting rod is slidably connected with the second supporting rod, the first supporting rod and the second supporting rod are rotatably connected with the frame, respectively, and the supporting leg is configured to rotate to be received within the receiving cavity.

In one embodiment, the first supporting rod is provided thereon with a first sliding rail, the third supporting rod defines a first sliding groove thereon, and the first sliding rail is slidably connected with the first sliding groove.

In one embodiment, the supporting leg further includes a first limiting pillar, the third supporting rod further defines a first limiting hole communicating with the first sliding groove, the first limiting hole extending along the third supporting rod, the first limiting pillar has a first end fixed to the first supporting rod and a second end extending through the first limiting hole, and the first limiting pillar is slidable within the first limiting hole.

In one embodiment, the supporting leg further includes a first locking member, the second end of the first limiting pillar away from the first supporting rod is threaded to the first locking member, and the first locking member abuts against the third supporting rod.

In one embodiment, the third supporting rod defines a plurality of a first positioning holes communicating with the first limiting hole, the first locking member is provided with a first retaining ring matching with the first positioning holes, and the second end of the first limiting pillar away from the first supporting rod extends through the first retaining ring.

In one embodiment, the second supporting rod is provided thereon with a second sliding rail, the fourth supporting rod defines a second sliding groove thereon, and the second sliding rail is slidably connected with the second sliding groove.

In one embodiment, the supporting leg further includes a second limiting pillar, the fourth supporting rod further defines a second limiting hole communicating with the second sliding groove, the second limiting hole extending along the fourth supporting rod, the second limiting pillar has a first end fixed to the second supporting rod and a second end extending through the second limiting hole, and the second limiting pillar is slidable within the second limiting hole.

In one embodiment, the supporting leg further includes a second locking member, the second end of the second limiting pillar away from the second supporting rod is threaded to the second locking member, and the second locking member abuts against the fourth supporting rod.

In one embodiment, the fourth supporting rod defines a plurality of a second positioning holes communicating with the second limiting hole, the second locking member is provided with a second retaining ring matching with the second positioning holes, and the second end of the second limiting pillar away from the second supporting rod extends through the second retaining ring.

In one embodiment, the supporting leg further includes a mounting beam having opposing ends fixed to the third supporting rod and the fourth supporting rod, respectively.

In one embodiment, the frame includes a first beam and a second beam arranged in parallel, the first supporting rod is movably connected to the first beam, the second supporting rod is movably connected to the second beam, and when the supporting leg rotates in a third direction towards the frame until the first supporting rod and the second supporting rod abut against the frame, the supporting leg is prevented from further rotating in the third direction.

In one embodiment, the table leg structure further includes a first limiting member, where the first limiting member has one end rotatably connected to the first beam, and one other end provided with a first blocking portion and a first positioning portion, the first positioning portion is bent relative to the first limiting member, the first supporting rod defines a first locking hole thereon, and when the first limiting member rotates until the first blocking portion is received in the first locking hole, the first supporting rod is locked and is prevented from rotating.

In one embodiment, the first positioning portion is further provided with a first buckling portion which is bent with respect to the first positioning portion.

In one embodiment, the table leg structure further includes a second limiting member, wherein the second limiting member has one end rotatably connected to the second beam, and one other end provided with a second blocking portion and a second positioning portion, the second positioning portion is bent relative to the second limiting member, the second supporting rod defines a second locking hole thereon, and when the second limiting member rotates until the second blocking portion is received in the second locking hole, the second supporting rod is locked and is prevented from rotating.

In one embodiment, the second positioning portion is further provided with a second buckling portion which is bent with respect to the second positioning portion.

The invention has advantages as follows.

In the retractable and foldable table leg structure according to the present disclosure, the supporting leg is configured to rotate to be partly or entirely received within the receiving cavity, and is adjustable in height by sliding the third supporting rod and the fourth supporting rod.

DETAILED DESCRIPTION

The present disclosure will be further described below with reference to the accompanying drawings for more clearly and fully discussing the technical solutions of the present disclosure.

Figure 1:
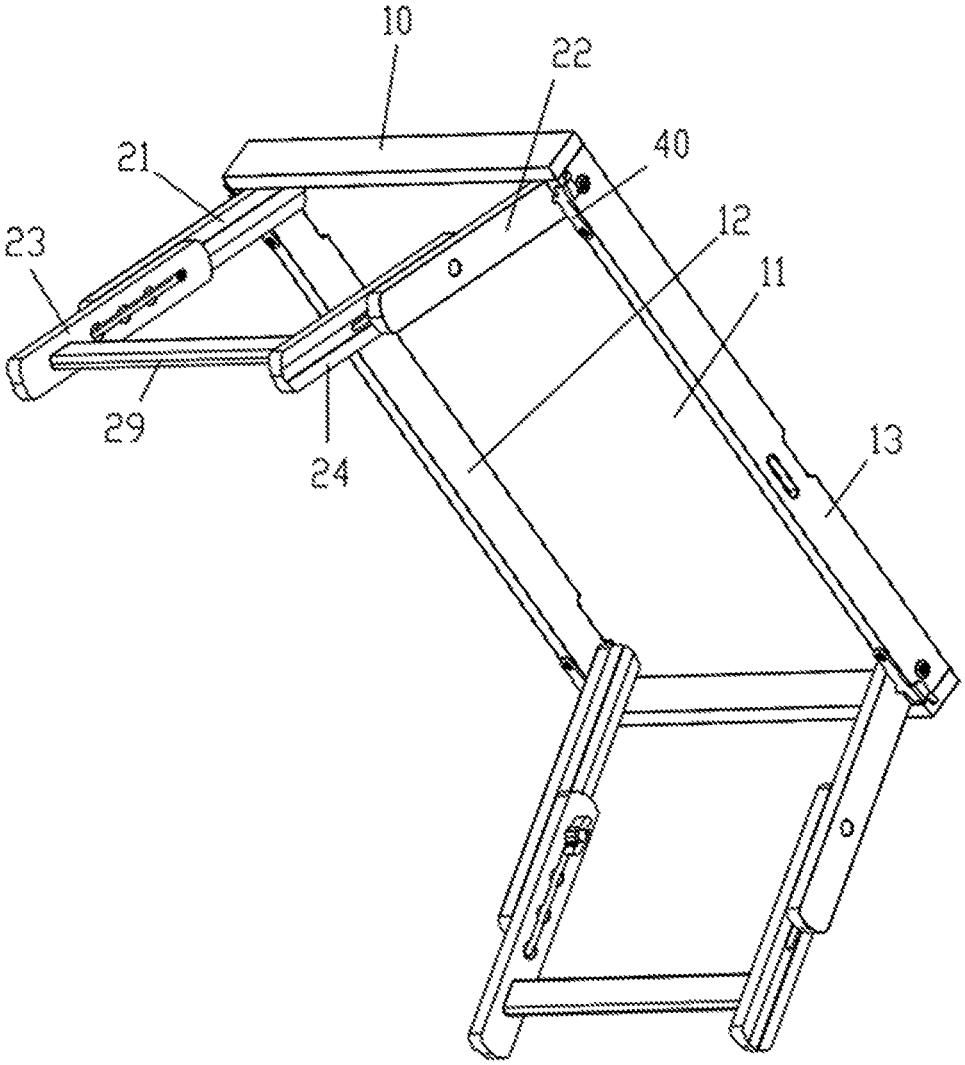
FIG. 1 is a perspective view of a retractable and foldable table leg structure according to the present disclosure.
Figure 2:
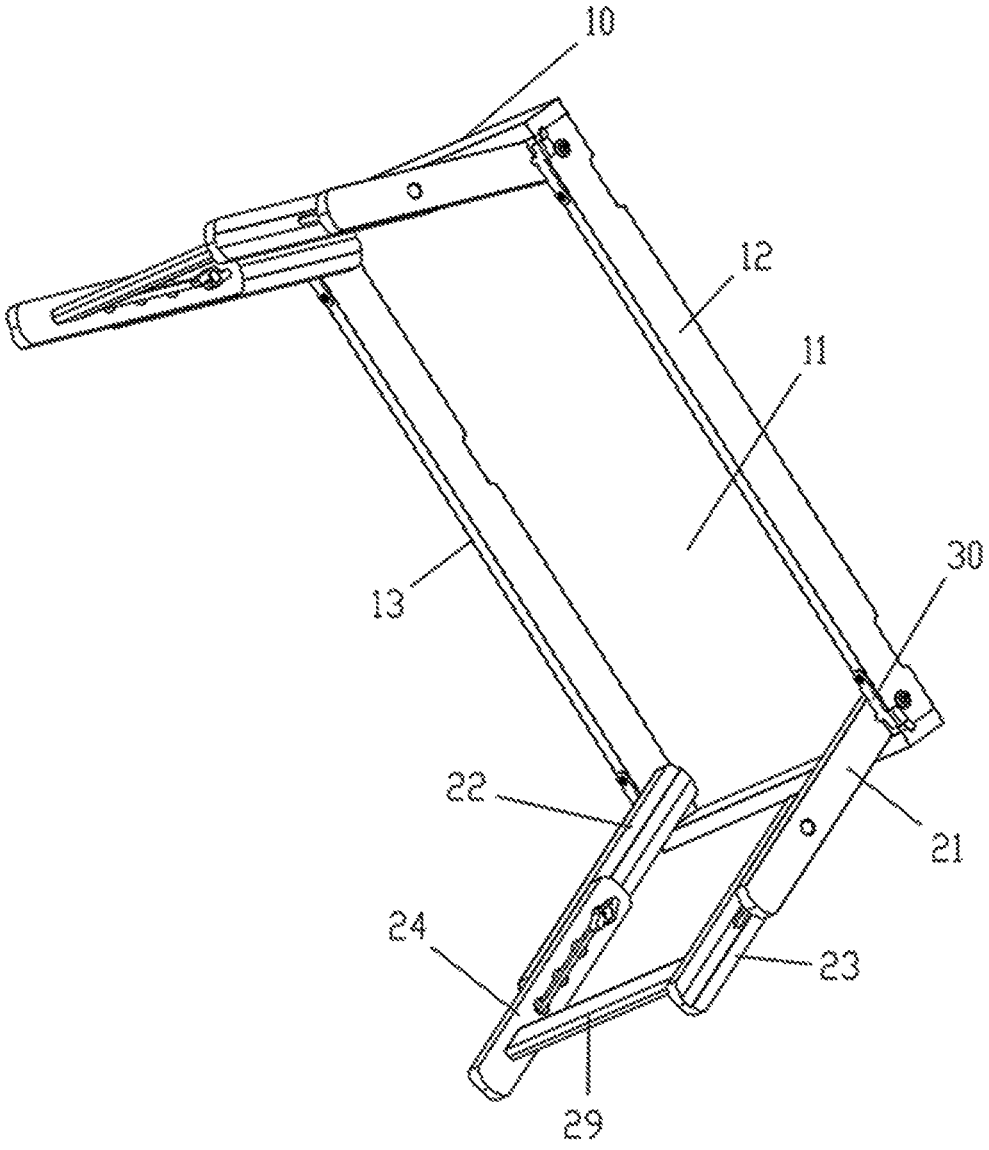
FIG. 2 is another perspective view of the retractable and foldable table leg structure according to the present disclosure.
Figure 3:
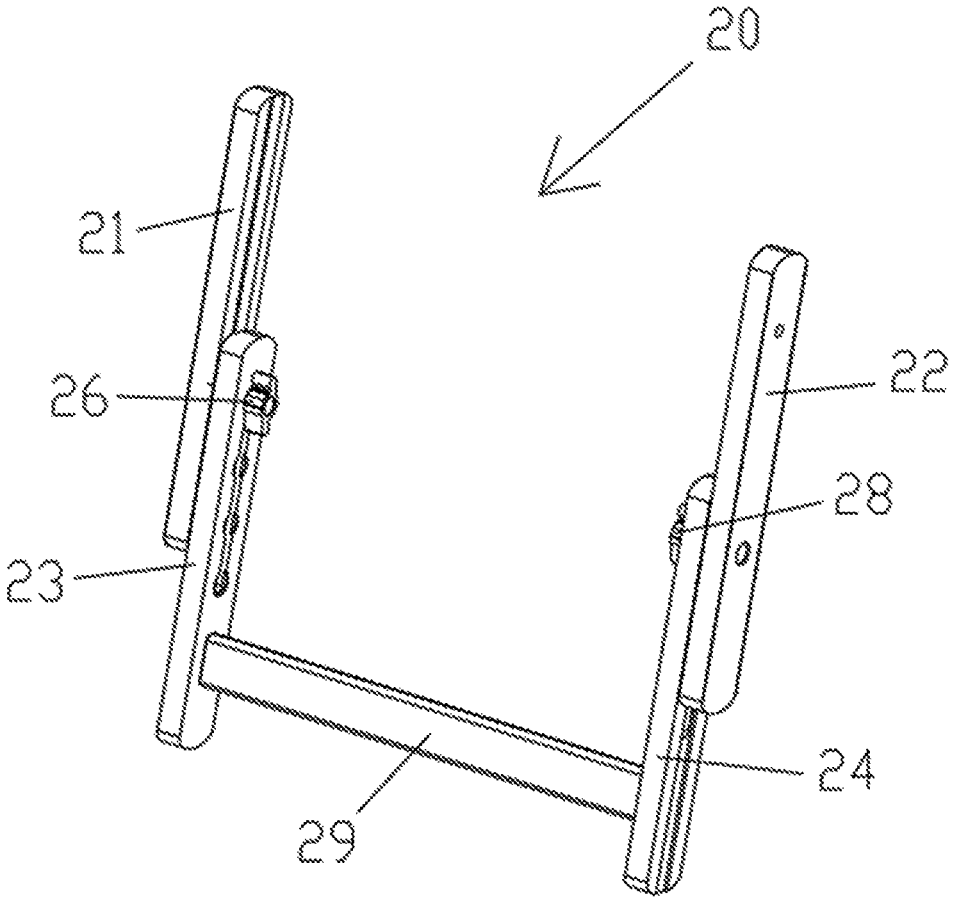
FIG. 3 is a perspective view of a supporting leg of the retractable and foldable table leg structure according to the present disclosure.
Figure 4:
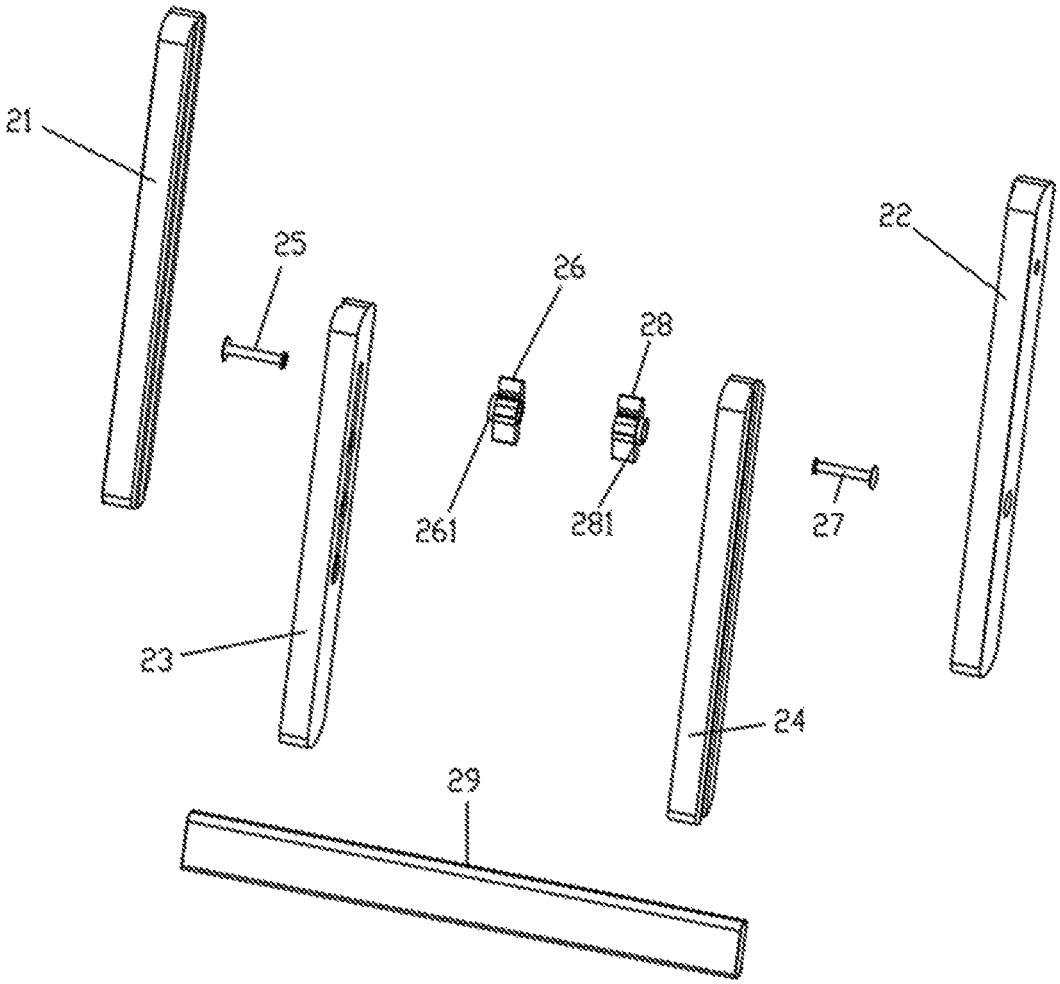
FIG. 4 is an exploded view of the supporting leg of the retractable and foldable table leg structure according to the present disclosure.
Figure 5:
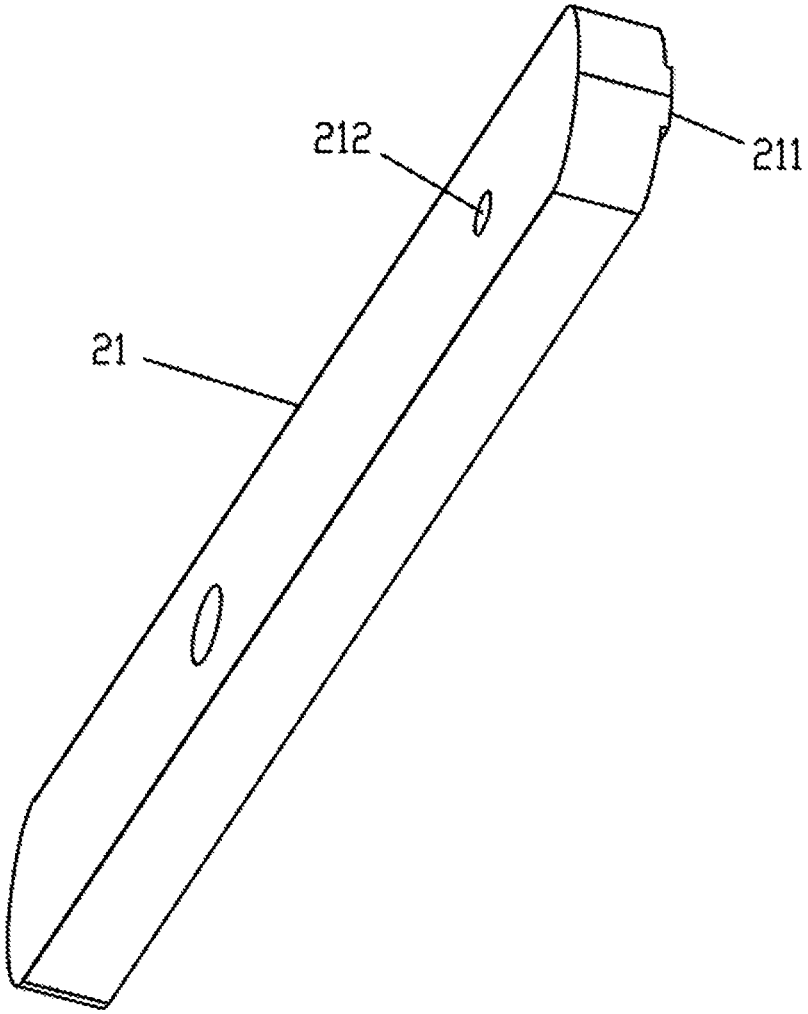
FIG. 5 is a perspective view of a first supporting rod of the retractable and foldable table leg structure according to the present disclosure.
Figure 6:
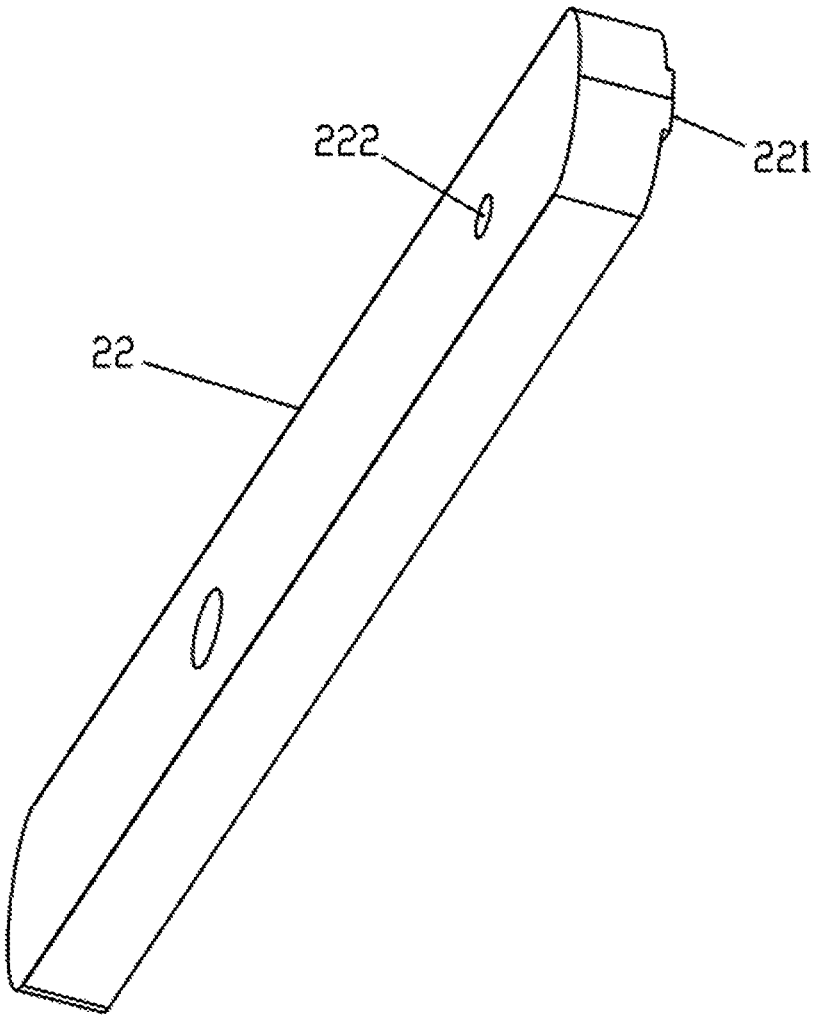
FIG. 6 is a perspective view of a second supporting rod of the retractable and foldable table leg structure according to the present disclosure.
Figure 7:
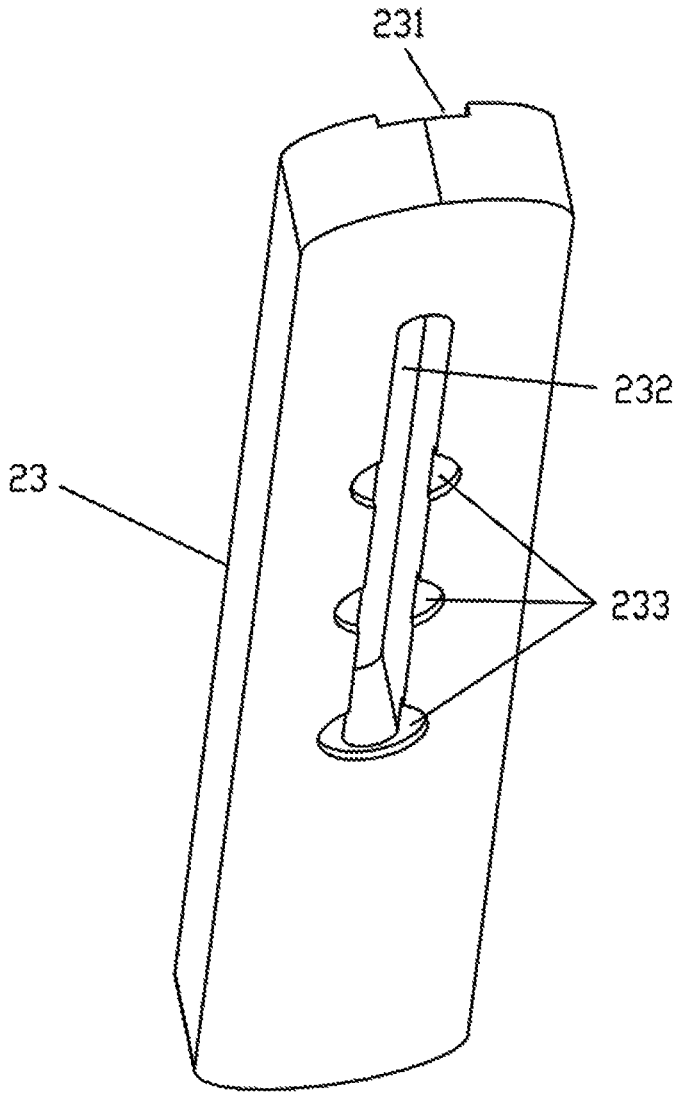
FIG. 7 is a perspective view of a third supporting rod of the retractable and foldable table leg structure according to the present disclosure.
Figure 8:
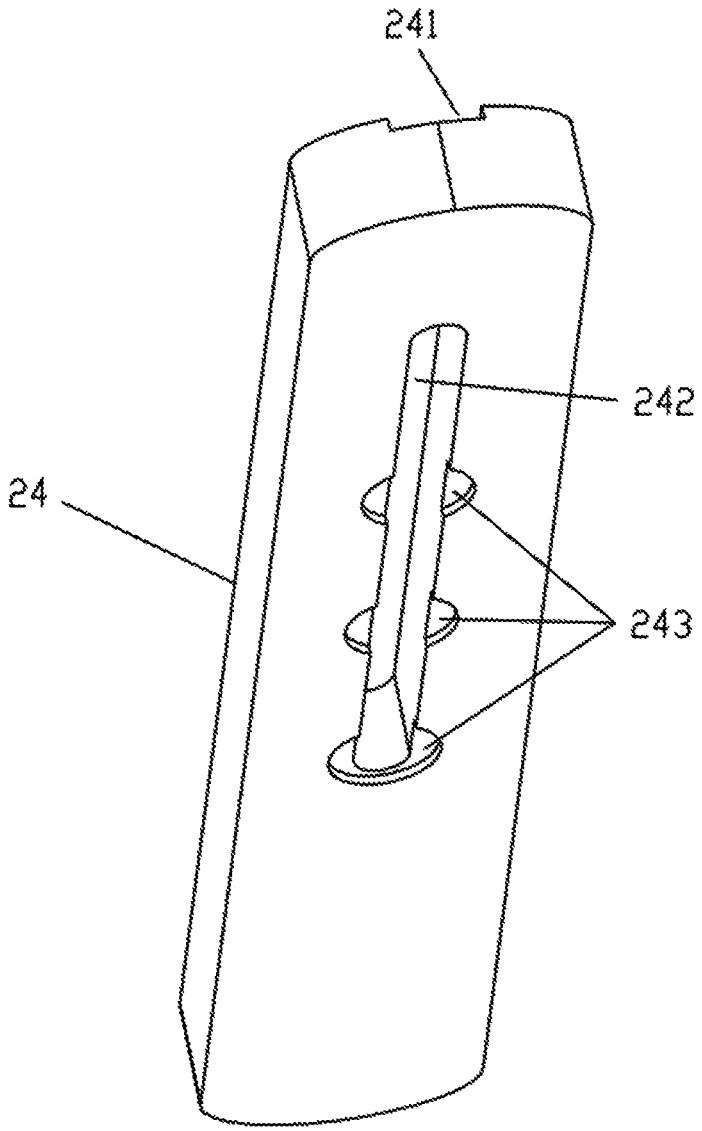
FIG. 8 is a perspective view of a fourth supporting rod of the retractable and foldable table leg structure according to the present disclosure.
Figure 9:
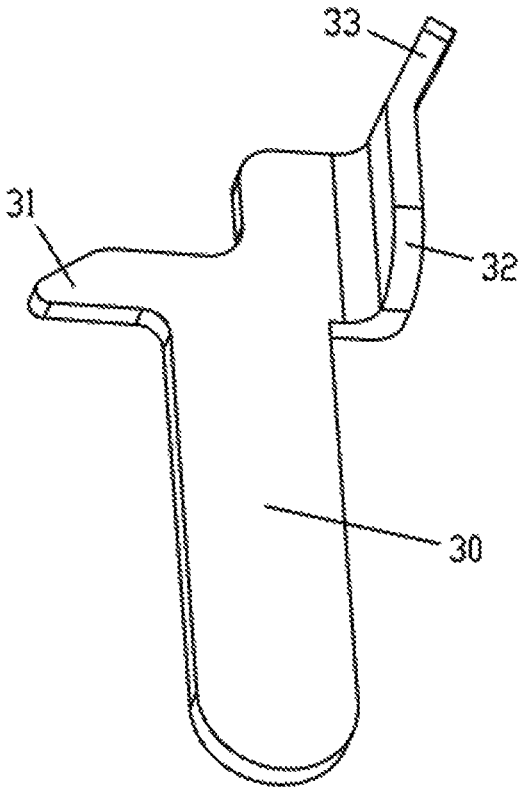
FIG. 9 is a perspective view of a first limiting member of the retractable and foldable table leg structure according to the present disclosure.
Figure 10:
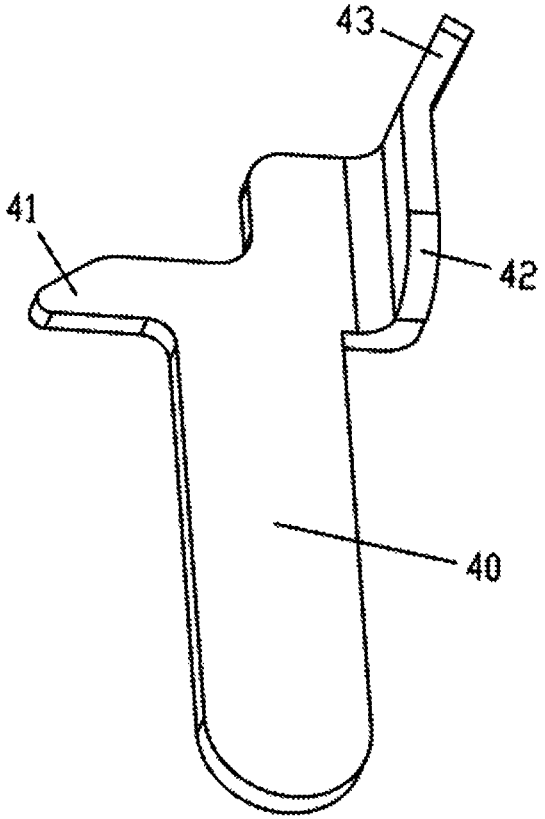
FIG. 10 is a perspective view of a second limiting member of the retractable and foldable table leg structure according to the present disclosure.

As shown in FIG. 1 to FIG. 10, a retractable and foldable table leg structure is provided according to an embodiment of the present disclosure. The table leg structure includes a frame 10 and a supporting leg 20. The frame 10 defines a receiving cavity 11. The supporting leg 20 includes a first supporting rod 21, a second supporting rod 22, a third supporting rod 23 and a fourth supporting rod 24. The third supporting rod 23 is slidably connected with the first supporting rod 21, and the fourth supporting rod 24 is slidably connected with the second supporting rod 22. The first supporting rod 21 and the second supporting rod 22 are rotatably connected with the frame 10, respectively. The supporting leg 20 is configured to rotate to be received within the receiving cavity 11.

In this embodiment, the first supporting rod 21 and the second supporting rod 22 are rotatably connected with the frame 10, respectively, such that a movable connection is formed between the supporting leg 20 and the frame 10. The supporting leg 20 is configured to rotate to be partly or entirely received within the receiving cavity 11. A height of the supporting leg 20 is adjustable by sliding the third supporting rod 23 and the fourth supporting rod 24.

Further, the first supporting rod 21 is provided thereon with a first sliding rail 211, and the third supporting rod 23 defines a first sliding groove 231 thereon. The first sliding rail 211 is slidably connected with the first sliding groove 231.

In this embodiment, the first sliding rail 211 matches with the first sliding groove 231, resulting in a stable sliding of the third supporting rod 23 relative to the first supporting rod 21.

Further, the supporting leg 20 further includes a first limiting pillar 25. The third supporting rod 23 further defines a first limiting hole 232 communicating with the first sliding groove 231. The first limiting hole 232 extending along the third supporting rod 23. The first limiting pillar 25 has a first end fixed to the first supporting rod 21 and a second end (opposite to the first end) extending through the first limiting hole 232. The first limiting pillar 25 is slidable within the first limiting hole 232.

Further, the supporting leg 20 further includes a first locking member 26. The second end of the first limiting pillar 25 away from the first supporting rod 21 is threaded to the first locking member 26, and the first locking member 26 abuts against the third supporting rod 23.

In this embodiment, the third supporting rod 23 may be closely attached to the first supporting rod 21 by means of screwing the first locking member 26, so that the third supporting rod 23 is locked. In this way, the third supporting rod 23 is prevented from sliding relative to the first supporting rod 21.

In this embodiment, when the third supporting rod 23 slides relative to the first supporting rod 21 in a first direction towards the first limiting hole 232 until the first limiting pillar 25 abuts against a sidewall of the first limiting hole 232, the third supporting rod 23 is prevented from further sliding in the first direction.

Further, the third supporting rod 23 defines a plurality of a first positioning holes 233 communicating with the first limiting hole 232. The first locking member 26 is provided with a first retaining ring 261 matching with the first positioning holes 233. The second end of the first limiting pillar 25 away from the first supporting rod 21 extends through the first retaining ring 261.

In this embodiment, the second end of the first limiting pillar 25 away from the first supporting rod 21 extends through the first retaining ring 261 and is threaded to the first locking member 26. The third supporting rod 23 is slid to align one of the first positioning holes 233 with the first retaining ring 261, and the first locking member 26 is screwed to make the first retaining ring 261 abut against a bottom wall of the one of the first positioning holes 233. In this way, the first retaining ring 261 is fitted into the one of the first positioning holes 233 to further prevent the third supporting rod 23 from sliding.

Further, the second supporting rod 22 is provided thereon with a second sliding rail 221, and the fourth supporting rod 24 defines a second sliding groove 241 thereon. The second sliding rail 221 is slidably connected with the second sliding groove 241.

In this embodiment, the second sliding rail 221 matches with the second sliding groove 241, resulting in a stable sliding of the fourth supporting rod 24 relative to the second supporting rod 22.

Further, the supporting leg 20 further includes a second limiting pillar 27. The fourth supporting rod 24 further defines a second limiting hole 242 communicating with the second sliding groove 241. The second limiting hole 242 extending along the fourth supporting rod 24. The second limiting pillar 27 has a first end fixed to the second supporting rod 22 and a second end (opposite to the first end) extending through the second limiting hole 242. The second limiting pillar 27 is slidable within the second limiting hole 242.

Further, the supporting leg 20 further includes a second locking member 28. The second end of the second limiting pillar 27 away from the second supporting rod 22 is threaded to the second locking member 28, and the second locking member 28 abuts against the fourth supporting rod 24.

In this embodiment, the fourth supporting rod 24 may be closely attached to the second supporting rod 22 by means of screwing the second locking member 28, so that the fourth supporting rod 24 is locked. In this way, the fourth supporting rod 24 is prevented from sliding relative to the second supporting rod 22.

In this embodiment, when the fourth supporting rod 24 slides relative to the second supporting rod 22 in a second direction towards the second limiting hole 242 until the second limiting pillar 27 abuts against a sidewall of the second limiting hole 242, the fourth supporting rod 24 is prevented from further sliding in the second direction.

Further, the fourth supporting rod 24 defines a plurality of a second positioning holes 243 communicating with the second limiting hole 242. The second locking member 28 is provided with a second retaining ring 281 matching with the second positioning holes 243. The second end of the second limiting pillar 27 away from the second supporting rod 22 extends through the second retaining ring 281.

In this embodiment, the second end of the second limiting pillar 27 away from the second supporting rod 22 extends through the second retaining ring 281 and is threaded to the second locking member 28. The fourth supporting rod 24 is slid to align one of the second positioning holes 243 with the second retaining ring 281, and the second locking member 28 is screwed to make the second retaining ring 281 abut against a bottom wall of the one of the second positioning holes 243. In this way, the second retaining ring 281 is fitted into the one of the second positioning holes 243 to further prevent the fourth supporting rod 24 from sliding.

Further, the supporting leg 20 further includes a mounting beam 29 having opposing ends fixed to the third supporting rod 23 and the fourth supporting rod 24, respectively.

In this embodiment, the mounting beam 29 is pushed or pulled to enable a synchronous and equidistant movement of the third supporting rod 23 and the fourth supporting rod 24.

Further, the frame 10 includes a first beam 12 and a second beam 13 arranged in parallel, the first supporting rod 21 is movably connected to the first beam 12, and the second supporting rod 22 is movably connected to the second beam 13. When the supporting leg 20 rotates in a third direction towards the frame 10 until the first supporting rod 21 and the second supporting rod 22 abut against the frame 10, the supporting leg 20 is prevented from further rotating in the third direction.

In this embodiment, one end of the first supporting rod 21 is received in the receiving cavity 11 and movably connected with the first beam 12, and one end of the second supporting rod 22 is received in the receiving cavity 11 and movably connected to the second beam 13, so that the supporting leg 20 is rotatable to be completely received in the receiving cavity 11.

Further, the retractable and foldable table leg structure further includes a first limiting member 30, which has one end rotatably connected to the first beam 12, and one other end provided with a first blocking portion 31 and a first positioning portion 32. The first positioning portion 32 is bent relative to the first limiting member 30. The first supporting rod 21 defines a first locking hole 212 thereon. When the first limiting member 30 rotates until the first blocking portion 31 is received in the first locking hole 212, the first supporting rod 21 is locked and is prevented from rotating.

Further, the first positioning portion 32 is further provided with a first buckling portion 33 which is bent with respect to the first positioning portion 32.

Further, the retractable and foldable table leg structure further includes a second limiting member 40, which has one end rotatably connected to the second beam 13, and one other end provided with a second blocking portion 41 and a second positioning portion 42. The second positioning portion 42 is bent relative to the second limiting member 40. The second supporting rod 22 defines a second locking hole 222 thereon. When the second limiting member 40 rotates until the second blocking portion 41 is received in the second locking hole 222, the second supporting rod 22 is locked and is prevented from rotating.

Further, the second positioning portion 42 is further provided with a second buckling portion 43 which is bent with respect to the second positioning portion 42.

In this embodiment, after the support leg 20 rotates until the first supporting rod 21 and the second supporting rod 22 abut against the frame 10, the first limiting member 30 rotates until the first blocking portion 31 is received within the first locking hole 212, and the second limiting member 40 rotates until the second blocking portion 41 is received within the second locking hole 222. In this way, the supporting leg 20 is locked by the first limiting member 30 and the second limiting member 40, so as to be prevented from rotating.

In this embodiment, after the supporting leg 20 rotates to be completely received in the receiving cavity 11, the first limiting member 30 rotates to make the first blocking portion 31 abut against the first supporting rod 21, and the second limiting member 40 rotates to make the second blocking portion 41 abut against the second supporting rod 22, so that the supporting leg 20 is prevented from rotating and thus is securely received in the receiving cavity 11.

In this embodiment, when being rotated until the first positioning portion 32 abuts against the first supporting rod 21, a further rotation of the first limiting member 30 is not allowed. The first buckling portion 33 facilitates the user to rotate the first limiting member 30.

In this embodiment, when being rotated until the second positioning portion 42 abuts against the second supporting rod 22, a further rotation of the second limiting member 40 is not allowed. The second buckling portion 43 facilitates the user to rotate the second limiting member 40.

It should be noted that the present disclosure may have other various embodiments. Modifications and variations made by those skilled in the art based on the embodiments according to the present disclosure without any creative work also fall within the scope of the present disclosure.

What is claimed is:

1. A retractable and foldable table leg structure, comprising a frame and a supporting leg, wherein the frame defines a receiving cavity, the supporting leg comprises a first supporting rod, a second supporting rod, a third supporting rod and a fourth supporting rod, the third supporting rod is slidably connected with the first supporting rod, the fourth supporting rod is slidably connected with the second supporting rod, the first supporting rod and the second supporting rod are rotatably connected with the frame, respectively, and the supporting leg is configured to rotate to be received within the receiving cavity;

wherein the first supporting rod is provided thereon with a first sliding rail, the third supporting rod defines a first sliding groove thereon, and the first sliding rail is slidably connected with the first sliding groove.

2. The table leg structure according to claim 1, wherein the supporting leg further comprises a first limiting pillar, the third supporting rod further defines a first limiting hole communicating with the first sliding groove, the first limiting hole extending along the third supporting rod, the first limiting pillar has a first end fixed to the first supporting rod and a second end extending through the first limiting hole, and the first limiting pillar is slidable within the first limiting hole.

3. The table leg structure according to claim 2, wherein the supporting leg further comprises a first locking member, the second end of the first limiting pillar away from the first supporting rod is threaded to the first locking member, and the first locking member abuts against the third supporting rod.

4. The table leg structure according to claim 3, wherein the third supporting rod defines a plurality of a first positioning holes communicating with the first limiting hole, the first locking member is provided with a first retaining ring matching with the first positioning holes, and the second end of the first limiting pillar away from the first supporting rod extends through the first retaining ring.

5. The table leg structure according to claim 1, wherein the second supporting rod is provided thereon with a second sliding rail, the fourth supporting rod defines a second sliding groove thereon, and the second sliding rail is slidably connected with the second sliding groove.

6. The table leg structure according to claim 5, wherein the supporting leg further comprises a second limiting pillar, the fourth supporting rod further defines a second limiting hole communicating with the second sliding groove, the second limiting hole extending along the fourth supporting rod, the second limiting pillar has a first end fixed to the second supporting rod and a second end extending through the second limiting hole, and the second limiting pillar is slidable within the second limiting hole.

7. The table leg structure according to claim 6, wherein the supporting leg further comprises a second locking member, the second end of the second limiting pillar away from the second supporting rod is threaded to the second locking member, and the second locking member abuts against the fourth supporting rod.

8. The table leg structure according to claim 7, wherein the fourth supporting rod defines a plurality of a second positioning holes communicating with the second limiting hole, the second locking member is provided with a second retaining ring matching with the second positioning holes, and the second end of the second limiting pillar away from the second supporting rod extends through the second retaining ring.

9. The table leg structure according to claim 1, wherein the supporting leg further comprises a mounting beam having opposing ends fixed to the third supporting rod and the fourth supporting rod, respectively.

10. The table leg structure according to claim 1, wherein the frame comprises a first beam and a second beam arranged in parallel, the first supporting rod is movably connected to the first beam, the second supporting rod is movably connected to the second beam, and when the supporting leg rotates in a third direction towards the frame until the first supporting rod and the second supporting rod abut against the frame, the supporting leg is prevented from further rotating in the third direction.

11. The table leg structure according to claim 10, further comprising a first limiting member, wherein the first limiting member has one end rotatably connected to the first beam, and one other end provided with a first blocking portion and a first positioning portion, the first positioning portion is bent relative to the first limiting member, the first supporting rod defines a first locking hole thereon, and when the first limiting member rotates until the first blocking portion is received in the first locking hole, the first supporting rod is locked and is prevented from rotating.

12. The table leg structure according to claim 11, wherein the first positioning portion is further provided with a first buckling portion which is bent with respect to the first positioning portion.

13. The table leg structure according to claim 10, further comprising a second limiting member, wherein the second limiting member has one end rotatably connected to the second beam, and one other end provided with a second blocking portion and a second positioning portion, the second positioning portion is bent relative to the second limiting member, the second supporting rod defines a second locking hole thereon, and when the second limiting member rotates until the second blocking portion is received in the second locking hole, the second supporting rod is locked and is prevented from rotating.

14. The table leg structure according to claim 13, wherein the second positioning portion is further provided with a second buckling portion which is bent with respect to the second positioning portion.

15. A table leg structure, which is transformable between a folding state and an unfolding state, comprising a frame and a supporting leg, wherein the frame defines a receiving cavity, the supporting leg comprises a first supporting rod, a second supporting rod, a third supporting rod and a fourth supporting rod, the third supporting rod is slidably connected with the first supporting rod, the fourth supporting rod is slidably connected with the second supporting rod, the first supporting rod and the second supporting rod are rotatably connected with the frame, respectively, the supporting leg is received within the receiving cavity in the folding state; and wherein the frame comprises a first beam and a second beam arranged in parallel, the first supporting rod is rotatable connected to the first beam, the second supporting rod is rotatable connected to the second beam, and the frame further comprises a third beam connecting the first beam and the second beam, the first supporting rod and the second supporting rod rotate relative to the third beam to abut against the third beam when table leg structure is transformed from the folding state to the unfolding state.

16. A retractable and foldable table leg structure, comprising a frame and a supporting leg, wherein the frame defines a receiving cavity, the supporting leg comprises a first supporting rod, a second supporting rod, a third supporting rod and a fourth supporting rod, the third supporting rod is slidably connected with the first supporting rod, the fourth supporting rod is slidably connected with the second supporting rod, the first supporting rod and the second supporting rod are rotatably connected with the frame, respectively, and the supporting leg is configured to rotate to be received within the receiving cavity; and wherein the table leg structure further comprises a first limiting member having one end rotatably connected to the frame and one other end provided with a first blocking portion, the first supporting rod defines a first locking hole thereon, and the first supporting rod is locked and is prevented from rotating as the first blocking portion is received in the first locking hole.

17. The table leg structure according to claim 16, wherein the first limiting member further includes a first positioning portion bent relative to the first blocking portion, and first limiting member is prevented from rotating towards the first supporting rod as the positioning portion abuts against the frame.

18. The table leg structure according to claim 17, wherein the first limiting member further includes a first buckling portion bent relative to the first positioning portion.

* * * * *